US005279244A

United States Patent [19]

Perez-Collazo

[11] Patent Number: 5,279,244

[45] Date of Patent: Jan. 18, 1994

[54] COMBINED MOORING SLIP AND UNDERWATER BODY PROTECTOR AGAINST MARINE GROWTH

[75] Inventor: Eduardo Perez-Collazo, Guaynabo, P.R.

[73] Assignee: Commonwealth of Puerto Rico, San Juan, P.R.

[21] Appl. No.: 70,885

[22] Filed: Jun. 3, 1993

[51] Int. Cl.[5] ..... B63B 59/00

[52] U.S. Cl. ..... 114/222; 114/230

[58] Field of Search ..... 114/361, 221 R, 222, 230, 45; 405/63-68

[56] References Cited

U.S. PATENT DOCUMENTS 3,142,283 7/1964 Fisher .
3,205,851 9/1965 Wiswell, Jr. .
4,026,233 5/1977 Cox ..... 114/222
4,046,094 9/1977 Preiser et al. .
4,693,200 9/1987 Noble .
5,152,242 10/1992 Bradley .

FOREIGN PATENT DOCUMENTS 2430728 1/1976 Fed. Rep. of Germany ..... 114/222

*Primary Examiner*—Edwin L. Swinehart
*Attorney, Agent, or Firm*—Oblon, Spivak, McClelland, Maier & Neustadt

[57] ABSTRACT

An anti-fouling protector in the form of flexible envelope complementary to the underwater body of a vessel's hull is negatively buoyant and, when not in use, is stored on the bottom of a mooring slip. The invention includes structural features of the slip for guiding endless ropes fixed to the envelope for raising it around the vessel's underwater body when the vessel is moored in the slip, just before a vessel leaves the slip, lanyards connected to the envelope are detached from the vessel and the envelope sinks to its storage position on the bottom of the slip, where anchored lower rope guides prevent the envelope from being moved away by current.

11 Claims, 3 Drawing Sheets

COMBINED MOORING SLIP AND UNDERWATER BODY PROTECTOR AGAINST MARINE GROWTH

FIELD OF THE INVENTION

This invention relates to underwater body protectors against marine growth and more particularly to the combination of a mooring slip for a vessel and a protector against marine growth for the underwater body of a vessel moored in the slip.

BACKGROUND OF THE INVENTION

Protectors against marine growth in the form of water impervious envelopes complementary to the underwater shape of a vessel are known. Such envelopes after being positioned around the under body of the vessel are then filled with growth inhibiting liquids which may be only fresh water or water containing anti-fouling chemicals. The problem with such envelopes is that they are difficult to maneuver around the vessel's under body and various schemes have been resorted to to ease this task but no one system has been more efficacious than another and all have been burdensome.

The broad object of the present invention is to provide in combination with a boat slip a protector for an underwater body which is more easily maneuvered into and out of its position of use than in known systems.

SUMMARY OF THE INVENTION

The invention is directed to a combination of a mooring slip for a vessel and a hull protector which when not in its position of use and being heavier than water is stored on the bottom of the waterway of the slip. The protector is a water impervious flexible envelope and connected both to its bow and to its stern ends are points on endless flexible elements referred to in the specification as "ropes" though they could be of any similar flexible material. The endless flexible elements pass through a first set of rope guides which could be screw eyes located on above water structures such as the exposed upper ends of laterally spaced piles. The endless ropes pass through a second set of rope guides adjacent the submerged lower ends of the piles and which may be anchored to the poles or by anchor weights resting on the bottom. With the envelope collapsed on the bottom of the slip, the anchored lower rope guides cooperate with the ropes to restrain the envelope against being swept away by currents. When an appropriate part of a rope between the upper rope guide and the surface of the water is grasped as by a boat hook, the envelope can be raised and as this occurs the endless ropes run in one direction through the guides. After all the endless ropes have been pulled to elevate the envelope until its upper edge is positioned between the vessels water line and its deck, lanyards longitudinally spaced along the upper edge of the envelope are secured to the vessel as by being tied to the vessel's life line stanchions. After being thus positioned the envelope may have fresh water or other anti-fouling substance pumped in to the envelope to prevent marine growth on the hull. When the vessel is to leave the slip, the lanyards are simply cast off whereupon the envelope sinks to the bottom with the endless ropes travelling in the opposite direction through the guides until the envelope is in its collapsed condition on the bottom of the waterway defining the slip.

It is therefore an object of the invention to provide the combination of a slip and an anti-fouling protector for a vessel in the slip which can be easily applied to the vessel and readily removed and stored on the bottom of the slip when the vessel is absent.

Other objects and their attendant advantages will become apparent as the following detailed description is read in conjunction with the accompanying drawings wherein:

DETAILED DESCRIPTION OF THE INVENTION

Figure 1:
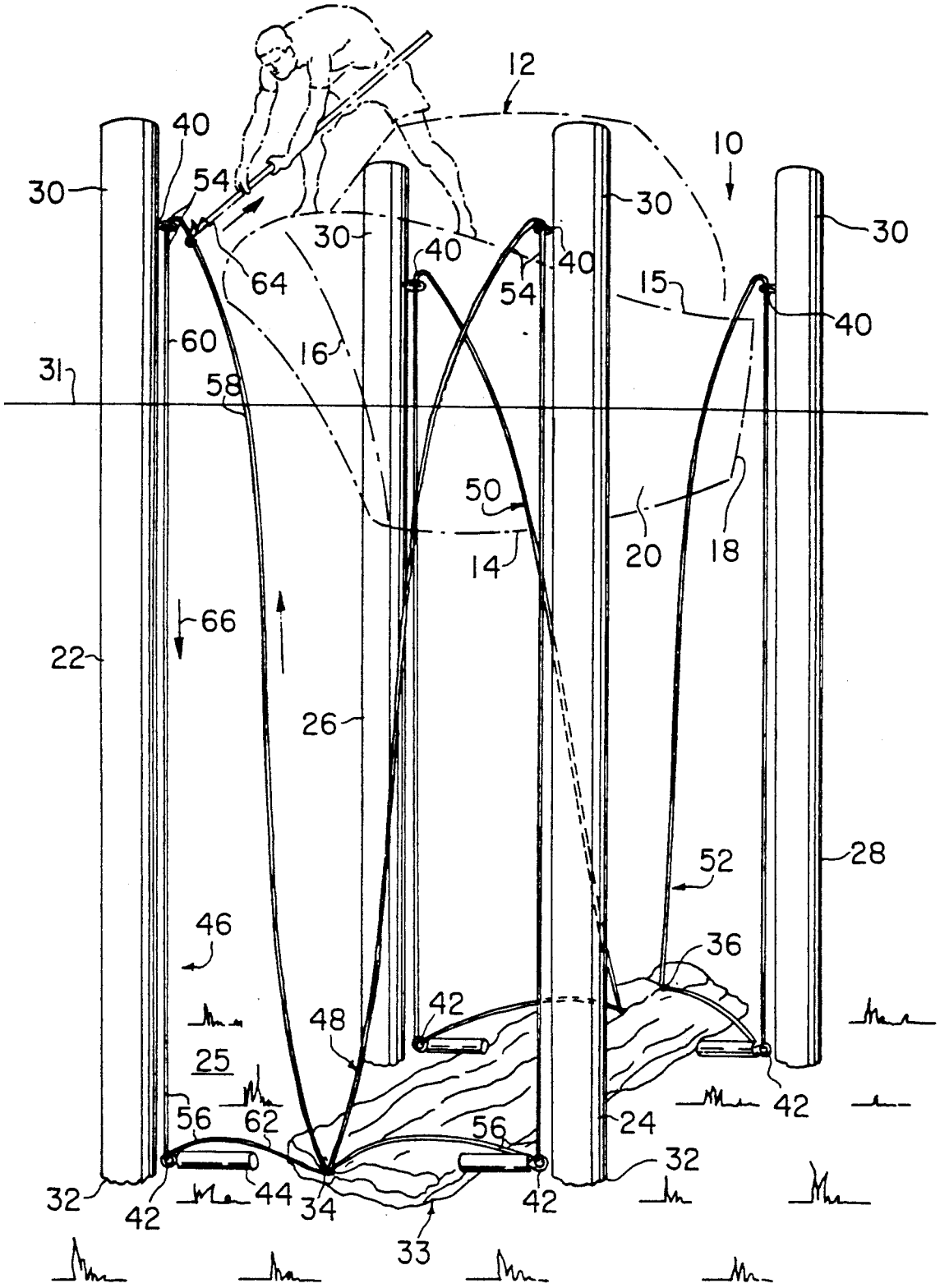
FIG. 1 is a perspective view of a boat slip with a vessel in said slip and the protector of the invention collapsed in a storage position on the bottom of the waterway of the slip.

The invention includes a boat slip broadly designated by the numeral 10 in which a vessel 12 may be moored. The vessel has a keel 14, deck 15, bow 16, stern 18 and sides 20. The slip 10 shown is defined by a first pair of laterally spaced piles 22, 24, driven into the bottom 25 of a waterway, in positions to be adjacent the bow 16 of the vessel 12 when moored in the slip. The slip is further defined by a second pair of laterally spaced piles 26, 28 in positions to be adjacent the stern 18 of the vessel 12. All of the piles have exposed upper ends 30 which extend above the surface 31 of the waterway and submerged lower ends 32.

Figure 2:
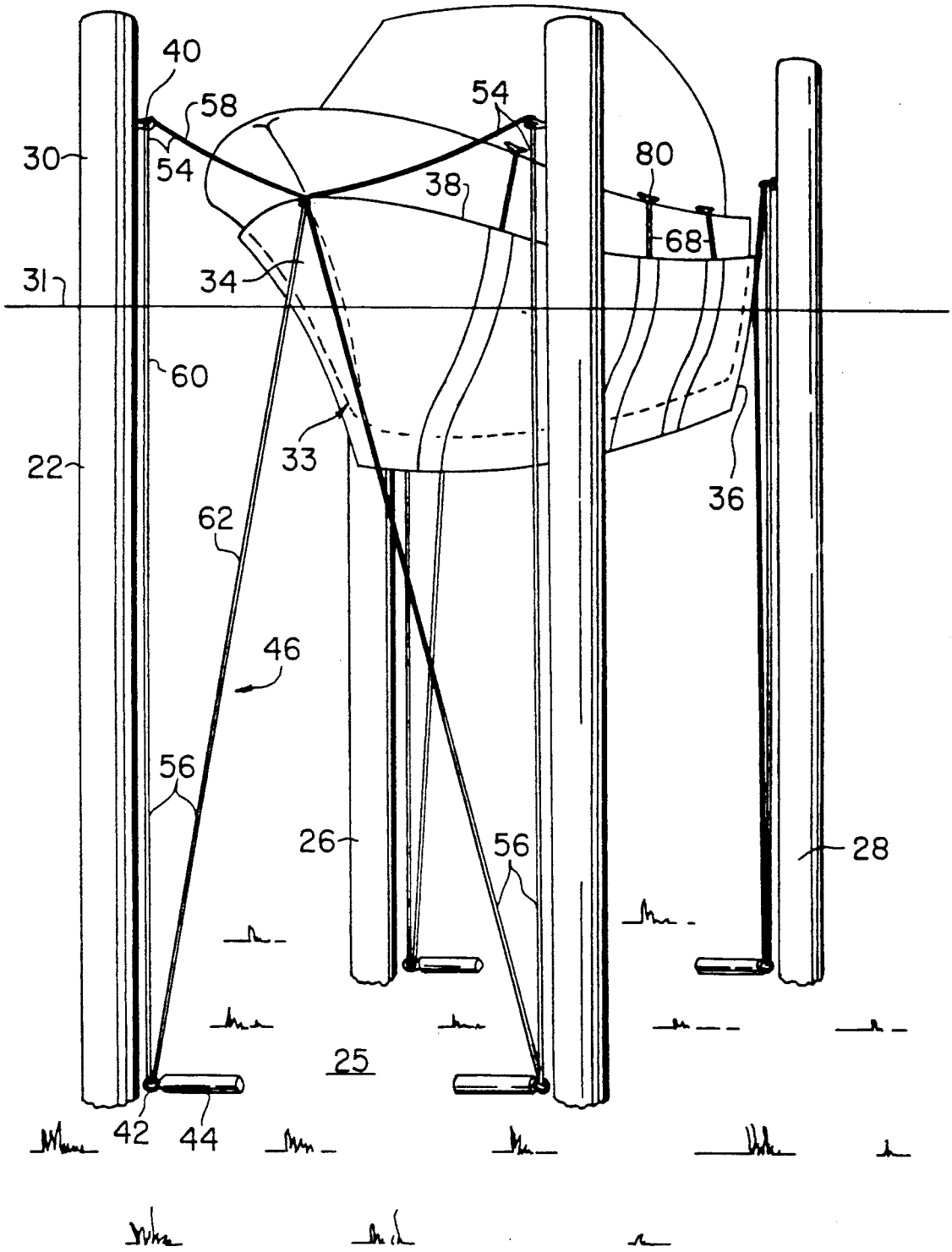
FIG. 2 is a perspective view showing the envelope in its raised position about a vessel in the slip.
Figure 3:
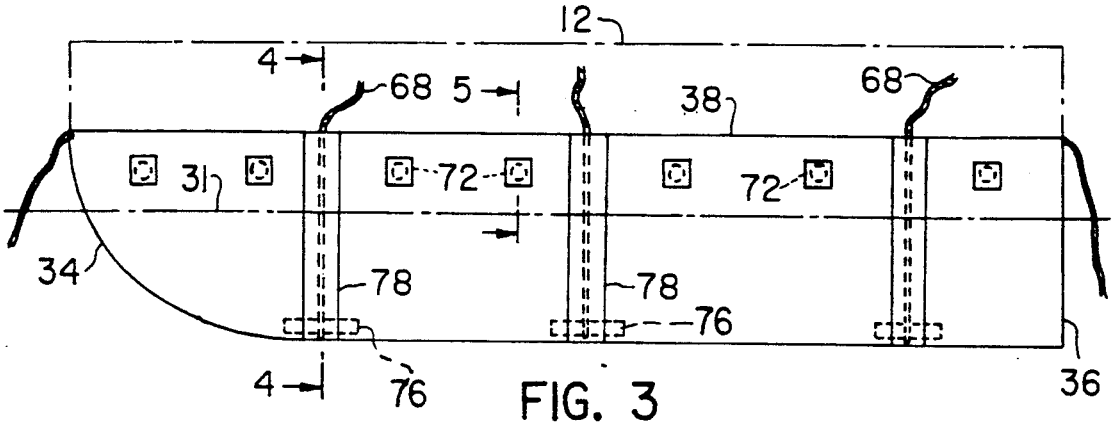
FIG. 3 is a side elevational, somewhat schematic view showing the protector envelope in place on a vessel.

The protector, broadly designated by the numeral 33, comprises an envelope of flexible water impervious material, such as Neoprene, having front and rear ends 34, 36 and an upper edge 38 as best seen in FIGS. 2 and 3. The envelope, when in its position of use, is of a size and shape complementary to a vessel's hull from its bow 16 to its stern 18 and from its keel 14 to a position, defined by the upper edge 38 of the envelope between the water line of the vessel, at the surface 31 of the waterway, and the deck 15 of the vessel.

An upper rope guide, which may be the screw eyes 40 shown, is fixed to each of the exposed upper ends 30 of the piles 22 through 28. Lower rope guides 42 are positioned adjacent the submerged lower ends 32 of the pile. The lower rope guides 42 could be screw eyes fixed to the lower ends of the piles adjacent the bottom 25 and such is contemplated as being within the purview of the invention. However, because it might be difficult to apply screw eyes to the piles beneath the water, the invention, as an alternative, provides anchors 44 which carry the rope guides 42 and position them on the bottom 25 of the waterway adjacent the lower ends of the piles 22, 24, 26, 28 substantially vertically beneath the upper rope guides 40.

In accordance with the invention, a first pair of endless ropes 46, 48 are each fixed at a point along the length of the rope to the front end 34 of the envelope 33 and movably extend through the upper and lower rope guides 40, 42 associated with respective bow piles 22, 24. A second pair of endless ropes 50, 52 are each fixed to the rear end 36 of the envelope, preferably adjacent the athwartships corners thereof, and movably extend through the upper and lower rope guides 40, 42 associated with the stern piles 26, 28. Upper and lower bights 54, 56 of each endless rope extends through each of the vertically spaced rope guides 40, 42, respectively. One part 58 of the upper bight extends between the upper rope guide 40 and the protector envelope. The other part 60 of the bight 54 extends between the upper and lower rope guides 40, 42 and also forms one part of the lower bight 56, the other part 62 of which extends between the lower guide 42 and the envelope. It will thus be seen that the portion of bight part 58 which is above the water surface 31 may be grasped, as by the boat hook 64 and pulled upwardly thereby raising that portion of the envelope to which that bight part 58 is connected. As the envelope moves towards the surface the other bight part 60 moves downwardly in the direction of the arrow 66 and the lower most bight part 62 increases in length the closer the envelope approaches the surface 31. The operator repeats this action with each of the respective endless ropes until the envelope 33 circumscribes the vessels hull from its keel 14 to the level of the upper edge 38 of the envelope as best shown in FIG. 2 whereupon lanyards 68 longitudinally spaced along the upper edge 38 of the envelope are fastened to the vessel, for example, to the longitudinally spaced cleats 80 shown or to life line stanchions (not shown) or any other convenient elements on the vessel. There should be a cleat or similar elements conveniently located close to each side of the bow and stern of the vessel so that when the envelope has been raised to the proper level the operator can, with one hand on the endless rope, retain the envelope in that position while, with his other hand, he properly secures the nearest lanyard 68 to the conveniently positioned cleat.

When the vessel is to leave the slip, the operator casts off the lanyards whereupon the envelope promptly sinks to its position of storage on the bottom of the waterway as shown in FIG. 1. The invention enables the operator to position the front end or either or both corners at the rear end of the envelope close to the bottom of the respective piles by pulling on the bight parts 60 opposite the arrow 66 in FIG. 1 thereby shortening the bight parts 62 and pulling the connecting points of the envelope and the endless ropes to positions adjacent the lower rope guides 42. This is particularly desirable at the stern corners to make as certain as possible that the endless ropes at that end are clear of the entrance to the slip.

Figure 6:
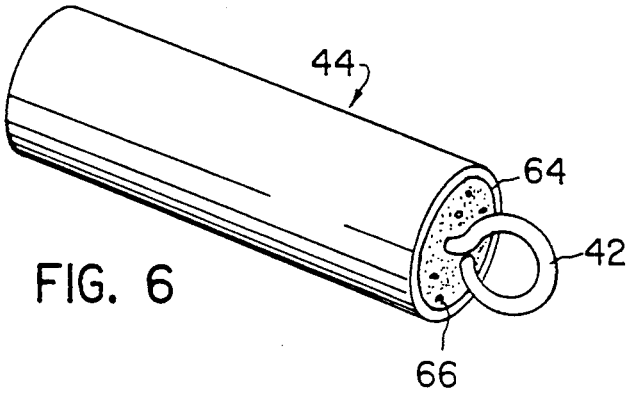
FIG. 6 is a perspective view of an anchor for a lower guide of the present invention.

FIG. 6 illustrates an anchor for a lower rope guide 42. The anchor can comprise a length of tubing 64 filled with concrete 66 in which the threaded end of an eye bolt, defining the lower rope guide 42 is embedded.

Figure 4:
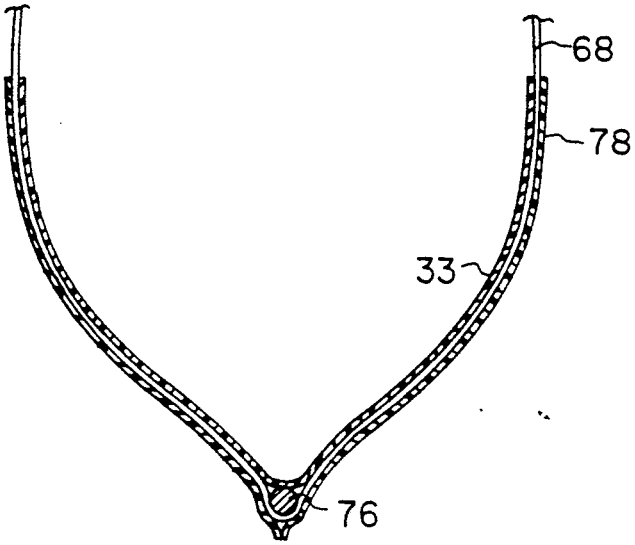
FIG. 4 is an enlarged vertical cross sectional view taken substantially on the line 4—4 of FIG. 3.

Because the negative buoyancy of certain envelope materials is slight, the invention calls for ballast weights 76 longitudinally spaced along the bottom of the envelope 33 as seen in FIGS. 3 and 4. The lanyards 68 extend from their exposed outer ends around the envelopes and under the weights 76. The lanyard ropes are sandwiched between the outer surface of the envelope and sleeves 78 which are adhered to the envelope surface by adhesives well known in the art as, for example, the adhesive use in the construction of inflatable boats.

Figure 5:
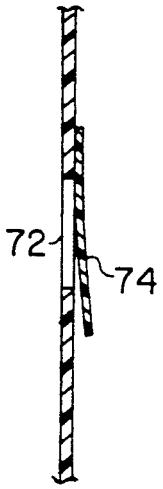
FIG. 5 is a partial, broken still further enlarged vertical cross sectional view taken substantially on the line 5—5 of FIG. 3.

Finally, it is desirable that the upper edge 38 of the envelope be high enough to impede the splashing by wave action of surrounding sea water into the envelope thereby diluting marine growth inhibitors within the envelope. However, a high upper edge also permits rain water flowing off the vessel to be trapped in the envelope which could adversely distort the shape of the envelope, even possibly rupturing it. To avoid this possibility, the invention provides one or more apertures 72 (FIG. 5) through that part of the envelope which is above the water line 31 when the envelope is in its position of use. To prevent surrounding water from entering the envelope through the apertures 72, each is covered with an outwardly opening flap 74 which operates like a check valve to permit excess water to drain out of the envelope but are closed by wave action of outside water to prevent it from flowing into the envelope.

Though the slip of the invention is shown as being defined by four piles it is within the purview of the invention for the slip to be defined by any other above-water structures, as for example, a main pier perpendicular to the fore and aft axis of the vessel and a finger pier parallel to that axis. With such an arrangement the upper rope guides could be attached to stringers at one end of the vessel and the lower rope guides totally dependent on anchors such as the anchors 44. The same arrangement could be resorted to at the opposite end of the vessel if the slip structure 50 so permits, though usually there will be piles at least at one end of a slip.

It is believed that the manner of use of the invention should be clear from the foregoing description. Naturally the invention is susceptible of a variety of changes and modifications without, however, departing from the scope and spirit of the appended claims.

What is claimed is:

1. The combination of a mooring slip for a vessel and a protector against marine growth for the underwater body of said vessel when moored in said slip, said slip comprising a first pair of laterally spaced piles driven into the bottom of a waterway in positions to be adjacent the bow of said vessel when moored in said slip and a second pair of laterally spaced piles driven into said bottom in positions to be adjacent the stern of said vessel when moored in said slip, all of said piles having exposed upper ends and submerged lower ends, said protector comprising an envelope of flexible water impervious material having front and rear ends and an upper edge, said envelope being of a size and shape complementary to the underwater part of a vessels hull from its bow to its stern and from its keel to a position between its water line and its deck, an upper rope guide fixed to each of the exposed upper ends of said piles, a lower rope guide adjacent the lower end of each pile where it intersects the bottom of said waterway, a first pair of endless ropes each fixed to the front end of said envelope and movably extending through said upper and lower rope guides associated with each of said first pair of piles, a second pair of endless ropes each fixed to the rear end of said envelope and movably extending through said upper and lower guides associated with each of said second pair of piles, said envelope having a weight of a magnitude causing it to sink in water while said endless ropes travel in one direction through said guides until said envelope rests on the bottom of said waterway defining said slip between said piles, each of said endless ropes being positioned that a part thereof between its upper guide and the water surface is graspable to raise said envelope until its upper edge is positioned between the water line and deck of said vessel, said endless ropes travelling in the opposite direction through said guides as said envelope is raised, and lanyards spaced longitudinally along said upper edge of said envelope for releasable attachment to said vessel to retain said envelope in its raised position about the hull of said vessel.

2. The combination of claim 1 wherein said lower rope guides include anchors fixed to said guides, said anchors being respectively positioned on the bottom of said waterway adjacent said lower end of each of said piles.

3. The combination of claim 1 including ballast weights attached to said envelope to ensure negative buoyancy thereof.

4. The combination of claim 3 wherein said ballast weights are disposed in the lowermost portion of said envelope, said lanyards being defined by the exposed outer ends of U-shaped lines sandwhiched between the material of said envelope and sleeves fixed to the exterior of the material of said envelope, the lowermost portion of each of said lines passing under and supporting a ballast weight.

5. The combination of claims 1 wherein that portion of said envelope between the water line and deck of said vessel has at least one drain opening therethrough to permit excess water in said envelope to drain out of the envelope.

6. The combination of claim 5 wherein said at least one opening has a flap thereover on the seaward side thereof, said flap, being closed against said opening by external sea water to prevent the entry of same by wave action into the envelope while permitting excess water in said envelope to flow out of said envelope.

7. The combination comprising a mooring slip having a depth of water above a bottom sufficient for a vessel moored in said slip, and a protector against marine growth for the underwater body of said vessel when moored in said slip, said slip including first and second above-water structures positioned to be adjacent respective opposite ends of a vessel when moored in said slip, said protector comprising a negatively buoyant body of flexible, water impervious sheet material which defines an envelope having front and rear ends and an upper edge, said envelope being of a size complementary to the underwater shape of the hull of said vessel from its bow to its stern and from its keel to a position defined by the upper edge of said envelope between the water line and deck of said vessel, a first pair of laterally spaced rope guides fixed above water to said first structure, a second pair of laterally spaced rope guides fixed above water to said second structure, below water rope guides fixed adjacent the bottom of said slip each in substantial vertical alignment with each of said above water rope guides, a first pair of endless ropes each fixed to said front end of said envelope and each passing through a respective pair of vertically aligned rope guides associated with said first structure, a second pair of endless ropes each fixed at a laterally spaced position to the rear end of said envelope and each passing through a pair of vertically aligned rope guides associated with said second structure, said endless ropes being positioned that a part thereof is graspable between an upper rope guide and the water surface to raise said envelope from the bottom of said slip and beneath a vessel moored in said slip until the upper edge of said envelope is positioned between the water line and deck of said vessel.

8. The combination of claim 7 wherein the lower rope guides are fixed to anchors lying on said bottom.

9. The combination of claim 7 wherein said envelope in its raised position is closely spaced from the hull of said vessel for the reception of marine growth inhibiting liquids into the space between said hull and said envelope.

10. The combination of claim 7 wherein the part of said envelope between the water line and deck of said vessel has drain apertures therethrough, and outwardly opening flaps over said aperture to permit water to flow from said envelope to the surrounding water while preventing the latter from flowing into said envelope.

11. The combination of claim 7 including lanyards longitudinally spaced along said upper edge of said envelope for releasable connection to said vessel.

* * * * *